United States Patent [19]

Awazu et al.

[11] Patent Number: 4,962,933

[45] Date of Patent: Oct. 16, 1990

[54] GOLF SWING PRACTICE DEVICE

[76] Inventors: Toshifumi Awazu; Hiroshi Awazu, both of 301 - 1945 Barclay Street, Vancouver, British Columbia, Canada, V6G 1L2

[21] Appl. No.: 304,013

[22] Filed: Jan. 30, 1989

[51] Int. Cl.[5] ..... A63R 69/36

[52] U.S. Cl. ..... 273/186 C; 273/191 R

[58] Field of Search ..... 273/186 R, 192, 191 R, 273/191 A, 191 B, 183 R, 183 A, 187 R, 186 B, 186 C, 186 D

[56] References Cited

U.S. PATENT DOCUMENTS

| | | | |
|---|---|---|---|
| 1,596,919 | 8/1926 | Burgoyne et al. | 273/186 R |
| 2,520,287 | 8/1950 | Plunkett et al. | 273/191 R |
| 2,653,025 | 9/1953 | Zega | 273/191 R |
| 2,933,681 | 4/1960 | Crain | 273/186 R |
| 3,332,688 | 7/1967 | Gevertz | 273/192 |
| 3,595,583 | 7/1971 | Oppenheimer | 273/191 R |
| 4,486,020 | 12/1984 | Kane | 273/191 R |
| 4,736,952 | 4/1988 | Taft et al. | 273/186 R |

FOREIGN PATENT DOCUMENTS

| | | | |
|---|---|---|---|
| 246923 | 6/1963 | Australia | 273/186 R |
| 872391 | 6/1971 | Canada | 273/191 R |
| 911478 | 10/1972 | Canada | 273/191 R |
| 949993 | 6/1974 | Canada | 273/191 R |
| 1216870 | 1/1987 | Canada | 273/191 R |
| 383767 | 11/1932 | United Kingdom | 273/186 R |
| 426822 | 10/1934 | United Kingdom | 273/186 R |

*Primary Examiner*—George J. Marlo

*Attorney, Agent, or Firm*—Cassidy, Vance & Tarleton

[57] ABSTRACT

A golf swing practice device (10) having an elongate flat guide member (11) defining a lineal guide edge (26) adapted to be placed on the ground adjacent to a golf ball (25) to be struck with the lineal guide edge (26) extending parallel to the desired and intended line-of-flight (28, 39) of the golf ball (25); an upstanding L-shaped guide element (14) having a vertical leg (15) and a horizontal leg (16) defining a swing plane stabilizer; a fastening device (13, 20) extending through an elongate vertical slot (19) formed in the guide member (11) and through the horizontal leg (16) formed on the swing plane stabilizer (14) so as to separably, but fixedly, secure the guide element (14) to the guide member (11) in any desired adjustable position along the length of the slot (19); and, a phantom tee (21) separably coupled to the guide member (11) adapted to be position forward of the golf ball (25) along the intended line-of-flight (28, 39) thereof for defining the intended bottom of the golfer's (29) swing when using long, intermediate and/or short irons, so as to induce the golfer (29) to commence his/her backswing with the club head (34, 38) passing closely adjacent to and somewhat beneath the level of the swing plane stabilizer (14) and to cause the golfer's downswing to follow a desired inside-out trajectory (35) and to impact the ball (25): (i) either at or just after reaching the bottom of the golfer's swing when using woods; and, (ii) during the golfer's downswing when utilizing long, intermediate and short irons.

9 Claims, 5 Drawing Sheets

GOLF SWING PRACTICE DEVICE

BACKGROUND OF THE INVENTION

1. Technical Field

The present invention relates to a golf swing practice device; and, more particularly, to a simple, lightweight, readily portable, inexpensive device that may be used by a golfer—whether male, female, adult, child, right-handed or left handed, and whether experienced or inexperienced—to practice and perfect the golfer's swings when using either woods, long irons, short irons, or when pitching, chipping and/or putting. More specifically, the present invention relates to a simple, yet highly effective, device which can be positioned relative to the lie of the golf ball so as to create an unobtrusive, imaginary barrier or guide plane parallel to the desired line-of-flight of the ball such that the golfer is constrained to swing the club with the same inside-out downswing trajectory every time, thereby: (i) improving the tendency to maintain the club face in a slightly closed position at the point of impact so as to propel the ball with a slight hook/draw trajectory which is desired; (ii) decreasing the tendency to maintain the club face in an open position at the point of impact so as to minimize the chances of propelling the ball along a fade/slice trajectory; (iii) increasing accuracy of the ball's line-of-flight; and (iv), increasing distance.

The exemplary golf swing practice device of the present invention may be used with equal facility for inducing proper golf swings when used with: (i) woods off the tee where it is generally desired that the point-of-impact between the ball and the club face occur just after the bottom of the golf swing—i.e., at the beginning of the golfer's upswing during follow-through; (ii) fairway woods ("3", "4" and "5" woods) and longer and intermediate irons ("1" irons through "6" irons) where it is generally desired that the point-of-impact between the ball and the club face occur on the downswing portion of the golfer's swing approximately four inches (4") to five inches (5") inches prior to reaching the bottom of the swing; and (iii) shorter irons ("7", "8" and "9" irons and/or wedges) where it is desired that the point-of-impact occur just prior to reaching the bottom of the downswing. Moreover, the device readily permits practice of such shots as pitchs, chips and/or putts where it serves to minimize the natural tendency of the golfer to employ an excessive backswing.

2. Background Art

In recent years, the sport of golf has achieved everincreasing popularity with both old and young alike, as well as males and females, all of whom are desirous of improving their golf score to the greatest degree possible. However, many of those individuals do not have access to, and/or cannot afford the luxury of tutoring by, a qualified golf professional. As a consequence, the average non-professional golfer rapidly gets into the habit of making fundamental errors in his/her swing which result in improper clubface/ball impact and, therefor, skyrocketing scores. As a result, there has long been a need for a simple teaching aid which is not expensive, which can be used by anyone irrespective of their physical abilities and/or disabilities, and which enables the golfer to repetitively employ a proper golf swing—swings which will differ from club to club—for virtually any condition encountered, be it a wood or an iron shot from the tee or fairway, an approach shot such as a pitch or chip, or when putting.

Indeed, the prior art is replete with patents showing a wide variety of such devices For example, U.S. Pat. No. 2,520,287—Plunkett et al. discloses a relatively cumbersome and complex curvilinear guide within which the head of the club is located and which serves to confine the club head to the same arcuate path on both the backswing and the downswing. Not only is such device relatively large and expensive, but, moreover, the use thereof does not prepare the golfer for actual playing conditions where there are no restraining guides. Indeed, the Plunkett et al device is believed to be undesirable because it tends to induce the golfer to move the club head in the same curvilinear path on both the backswing and the downswing, thereby preventing the golfer from employing a correct inside-out swing. A similar apparatus subject to all of the same disadvantages is disclosed in U.S. Pat. No. 2,653,025—Zega. Moreover, both of the foregoing devices are limited to use with right-handed golfers; and, a completely different design is required for use by left-handed players.

In U.S. Pat. No. 3,595,583—Oppenheimer, the patentee proposes the use of a relatively complex harness worn by the golfer and having a guy secured to the club head and to the harness for controlling the path through which the club head passes. Such a harness not only interferes with the golfer's natural free swing, but, additionally, it can promote movement of the golfer's shoulders to undesired positions which result in an improper swing.

Yet another apparatus is disclosed in, for example, the more recently issued U.S Pat. No. 4,486,020—Kane et al wherein a wall-mounted unit is releasably attached to the club so that when in use the club is forced to move along a fixed arcuate path for both the backswing and the downswing.

Canadian Pat. Nos. 872,391—Gentry (1971), 911,478—Hetman et al (1972), and 1,216,870—Shipley (1987) are all of incidental interest for their disclosures of control devices for golf swings which are quite similar to that disclosed in the aforesaid Kane, U.S. Pat. No. 4,486,020—that is, in each of these devices the club is tethered to a wall or other fixed object so as to insure that the club head moves in the same curvilinear path at all times irrespective of whether it is being moved during the backswing or the downswing.

Finally, attention is directed to Canadian Pat. No. 949,993—Seltzer (1974) where the patentee discloses a golf club swing guide quite similar to that shown in the aforesaid Plunkett et al U.S. Pat. No. 2,520,287 except that in this instance the highly complex guide includes one curvilinear track for the backswing and a second curvilinear track for the downswing so as to hopefully train the golfer to utilize the correct inside-out swing so critical to accuracy and distance. As in the case of Plunkett et al, the Seltzer device requires different designs for right and left-handed golfers, as well as for golfers of differing heights.

Unfortunately, however, none of the devices disclosed in the foregoing patents are realistically suited for teaching proper golf swings. Thus, in each instance the golf club is physically coupled to some type of restraint device; yet, when the golfer encounters actual playing conditions that restraint device is no longer present and, consequently, the golfer's swing during actual playing conditions is being made under conditions markedly different from those encountered when using the training device. Moreover, except for the heavy, cumbersome and complex device proposed in the aforesaid Seltzer Canadian Pat. No. 949,993 (1974), each of the other devices improperly trains the golfer to swing the club head along the same curvilinear path on both backswing and downswing, thus promoting an outside-in swing at impact and increasing the tendency to develop an undesirable fade or slice. Finally, none of the foregoing devices is suitable for use under actual playing conditions; and, none is suitable for use in practice pitching, chipping and/or putting. Indeed, each must be specially designed to be compatible for use with right-handed and left-handed golfers, male and female golfers whose statures are generally quite different, and for tall golfers on the one hand and short on the other.

SUMMARY OF THE INVENTION

The present invention overcomes all of the disadvantages inherent in the foregoing systems by providing a simple, lightweight, economical, portable device which can be used with equal facility by all golfers—whether experienced or inexperienced, male or female, adult or child, tall or short, right-handed or left-handed—both under practice conditions and under actual playing conditions. The device: (i) does not require the use of any physical or mechanical constraint on the golfer's swing; (ii) promotes the development of a proper inside-out swing; (iii) can be used with the different swings required for woods, long irons, intermediate irons and short irons; and (iv), can even be used to improve pitching, chipping and putting.

To this end, the golf swing practice device of the present invention comprises a generally flat elongate guide member, preferably calibrated in inches or other suitable distance units, adapted to be laid on the ground and defining a straight guide edge parallel to the desired line-of-flight of the golf ball. A separate upstanding guide element or "swing plane stabilizer" is mounted on the generally flat elongate guide member and is adapted to be fixedly, but adjustably, secured thereto in any desired position along the length of the flat elongate guide member so as to accommodate different swinging conditions. The generally flat elongate guide member and the upright swing plane stabilizer serve to establish a fixed, but unobtrusive, imaginary, vertical guide plane parallel to the desired line-of-flight for the golf ball and which serves to induce the golfer to maintain the club head in the proper position at all times during the backswing, thus inducing the proper inside-out downswing, all without the need for any physical and/or mechanical constraints. In short, the golfer can visually observe the position of the club head relative to the imaginary, unobtrusive, vertical guide plane defined by the device so as to insure that the club head does not penetrate the imaginary plane as would normally be the case should the golfer's swing be improper, describing an outside-in trajectory. Moreover, since the vertical guide plane is imaginary, there is no tendency to damage clubs and/or cause physical injury to the golfer as is the case when using mechanical guides and/or physical walls in the form of upright barriers. Indeed, with practice, and as the golfer becomes more proficient, a proper inside-out downswing becomes quite natural since no physical restraint and/or mechanical barriers are employed when using the practice device.

In the exemplary form of the invention, a moveable "spot" or phantom tee in the form of a washer-like element can be removably attached to the elongate flat guide member. This phantom tee readily permits the golfer to locate the actual lie of the ball approximately four inches (4") to about five inches (5") to the rear of the washer-like element or phantom tee which identifies a target for the low point of the golfer's swing when using long and/or intermediate irons so that the point-of-impact occurs during the golfer's downswing and approximately four inches (4") or five inches (5") prior to reaching the bottom of the downswing. Similarly, when practicing with shorter irons, the washer-like element or phantom tee can be positioned just in front of the golf ball's actual lie, thereby assisting the golfer in learning to impact the ball just prior to reaching the bottom of his/her downswing.

Finally, the calibrated nature of the generally flat elongate guide member and the inclusion of the adjustable upright swing plane stabilizer enables the golfer to position the latter a measured number of inches to the rear of the ball, thereby providing a guide or stop serving to limit the backswing during putts and promoting a straight and proper accelerating follow-through following impact with the golf ball which serves to control the distance and accuracy of the putt.

DESCRIPTION OF THE DRAWING

These and other objects and advantages of the present invention will become more readily apparent upon reading the following Detailed Description and upon reference to the attached drawings, in which.

Figure 1:
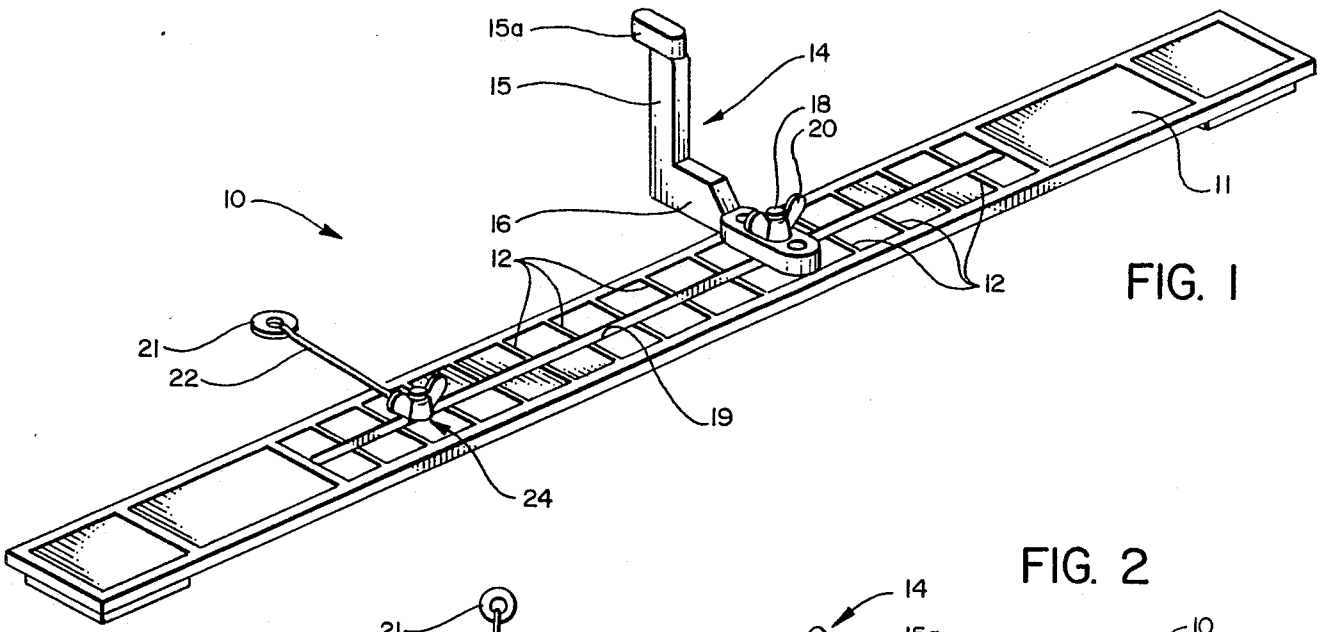
FIG. 1 is an isometric view of a golf swing practice device embodying the features of the present invention with the device here oriented for use by a left-handed golfer.

While the invention is susceptible of various modifications and alternative forms, a specific embodiment thereof has been shown by way of example in the drawings and will herein be described in detail. It should be understood, however, that it is not intended to limit the invention to the particular form disclosed but, on the contrary, the intention is to cover all modifications, equivalents and/or alternatives falling within the spirit and scope of the invention as expressed in the appended claims.

DETAILED DESCRIPTION

Figure 2:
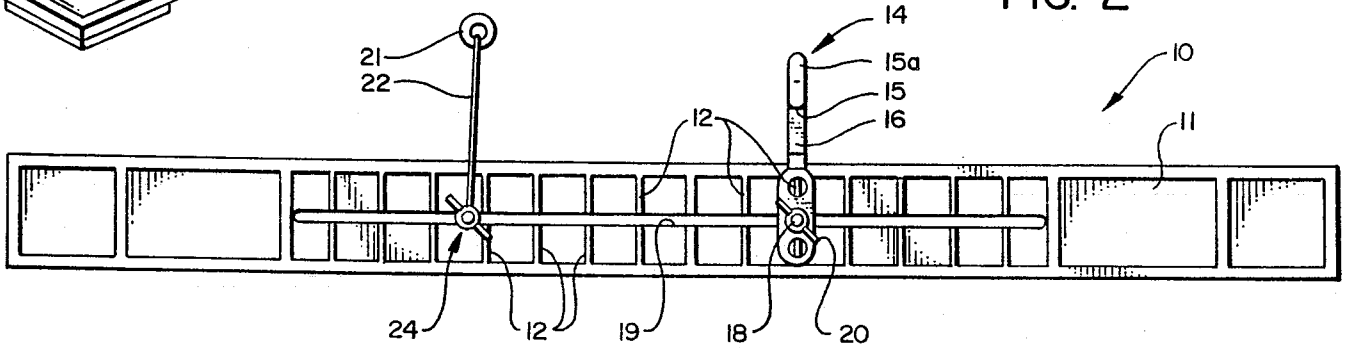
FIG. 2 is a plan view of the exemplary golf swing practice device shown in FIG. 1.

Turning now to the drawings, and as best illustrated by reference to FIGS. 1 and 2 conjointly, it will be observed that the exemplary golf swing practice device of the present invention, here generally indicated at 10, comprises an elongate, generally flat guide member 11 which may be formed of any desired material such, merely by way of example, as plastic, wood, metal, or the like. While the actual materials for, and dimensions of, the device 10 are not critical to the present invention, excellent results have been achieved using a clear, rigid, plastic sheet material approximately one-quarter inch (¼") in thickness, twenty-eight inches (28") in length, and two and one-half inches (2½") in width. The device 10 is preferably provided with calibration marks 12 spaced one inch (1") apart along a substantial portion of the length of the guide member 11.

In carrying out the invention, provision is made for developing an imaginary, unobtrusive, vertical guide plane adapted to be positioned parallel to the desired line-of-flight for the golf ball; and, to this end the device 10 includes a generally L-shaped vertical guide element or "swing plane stabilizer", generally indicated at 14, having an upright vertical leg 15 and an integral horizontal leg 16 adapted to be removably secured to the generally flat guide member 11 by means of a bolt 18 passing upwardly through an elongate slot 19 formed in the guide member 11 and through the horizontal leg 16 with the assembly being separably, but fixedly, held together with a wing nut 20 or the like. Thus, the arrangement is such that the swing plane stabilizer 14 can be easily shifted to any desired position along the length of the device 10 by merely loosening nut 20, sliding the swing plane stabilizer laterally along slot 19 to a desired calibration mark 12, and retightening nut 20. Just as in the case of guide member 11, the material from which the swing plane stabilizer 14 is formed is not critical to the present invention; but, excellent results have been achieved when employing a self-supporting, but relatively soft or flexible, piece of rubber or rubber-like material, thereby eliminating the possibility of damage to the club face should the club accidentally impact the swing plane stabilizer 14.

In order to establish a "spot" or phantom tee that can be used for designating the desired low point or bottom of the golf swing when practicing with irons—esp., long and intermediate irons—the exemplary device 10 preferably includes a simple, yet highly effective, marker in the form of a washer-shaped element 21 secured at one end of a short line or cord 22 having its opposite end removably secured to the guide member 11 by means of a nut and bolt combination, generally indicated at 24. In use the washer-like element 21 is positioned on the ground at that point forward of the golf ball 25 where the golfer intends his/her downswing to bottom out. That is, the washer-like element 21 defines an intended target located approximately three inches (3") to about four inches (4") in front of the lie of the golf ball when using long or intermediate irons (and immediately in front of the lie of the golf ball with short irons), thereby inducing the golfer to cause the club head to impact the ball during the downswing.

Figure 3:
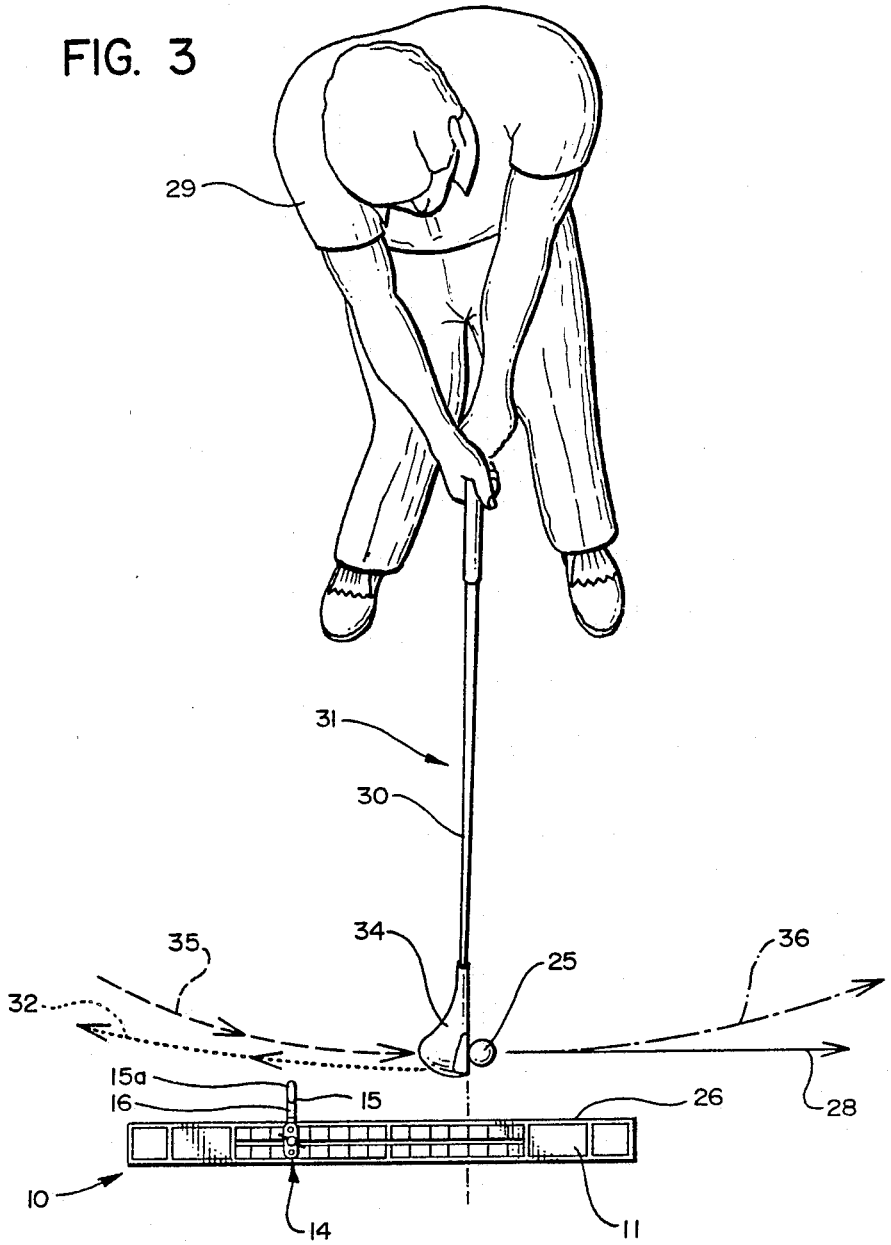
FIG. 3 is a diagrammatic, isometric view here illustrating usage of the golf swing practice device of FIG. 1 by a right-handed golfer to practice wood shots.

Referring now to FIG. 3, the use of the exemplary golf swing practice device 10 during a practice drive and/or fairway wood shot by a right-handed golfer has been illustrated. Thus, as here shown the device 10 is laid on the ground outboard of the golf ball 25 and defines an elongate lineal guide edge 26 parallel to the intended and desired line-of-flight of the ball 25 as represented by the arrow 28. The device 10 is further positioned such that when the golfer 29 addresses the ball 25, the shaft 30 of the golf club, generally indicated at 31, lies in a vertical plane normal to the guide edge 26 of the guide member 11 with the swing plane stabilizer 14 being fixedly secured to the device at a distance ranging from approximately four inches (4") to about five inches (5") behind the ball 25, it being understood that the actual distance between the ball 25 and the swing plane stabilizer will vary from golfer to golfer dependent upon such variables as the golfer's size, strength and normal swing, as well as the particular club being employed and the lie of the golf ball. Thus, when the golfer 29 commences his/her backswing along the curvilinear dotted line depicted at 32, the vertical leg 15 of the swing plane stabilizer 14, together with the guide edge 26 on guide member 11, define an unobtrusive, imaginary, vertical plane parallel to the desired and intended line-of-flight 28 of the golf ball 25, causing the club head 34 to pass adjacent, and preferably slightly below the level of, a laterally projecting tab 15*a* (FIG. 1) at the upper end of the vertical leg 15 of swing plane stabilizer 14. Moreover, as the golfer starts his/her downswing, the presence of the unobtrusive, imaginary, vertical guide plane defined by the swing plane stabilizer 14 and the guide edge 26 tends to induce the golfer to swing the club along a proper inside-out trajectory as indicated in the broken line trajectory depicted at 35 with the club head 34 impacting the ball 25 at the bottom of the swing and thereafter following an outside-in follow-through trajectory designated by the dash-dot line 36.

Since the exemplary golf swing practice device 10 of the present invention does not utilize any physical or mechanical restraints or barriers, repetitive use of the device serves to "groove" the golfer's swing in a highly desirable inside-out path during the downswing; and, when using woods the club head 34 impacts the ball 25 just after reaching the bottom of the downswing, thus producing a natural tendency to propel the ball 25 along a relatively straight and accurate trajectory as indicated by the arrow 28, preferably with a slight draw or hook trajectory.

Figure 4:
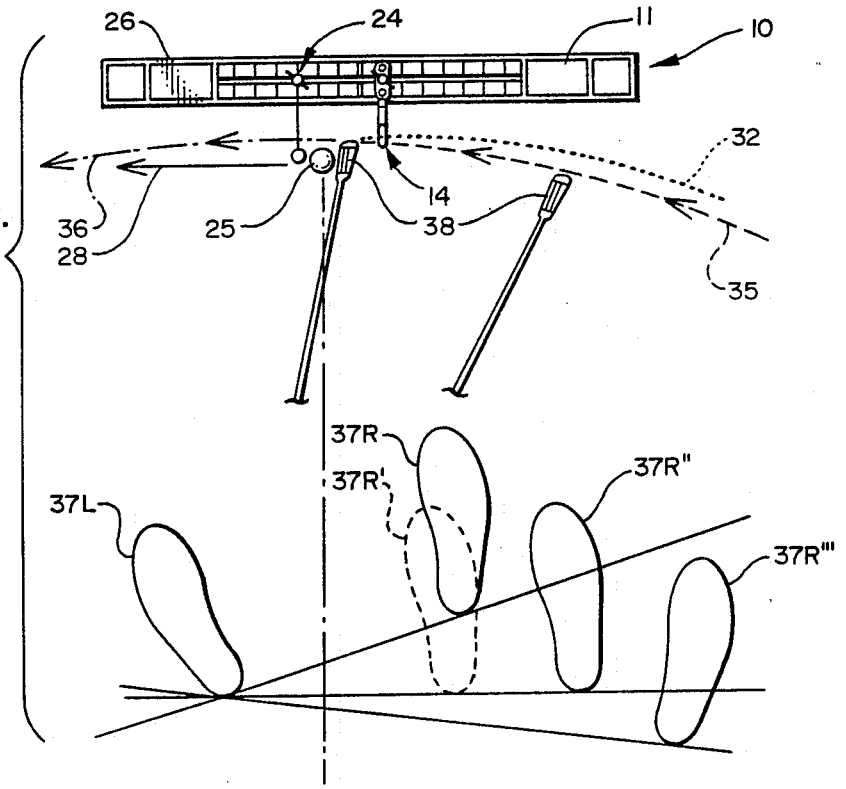
FIG. 4 is a fragmentary diagrammatic plan view here illustrating usage of the device shown in FIG. 1 by a right-handed golfer when utilizing long and/or intermediate irons and illustrating also the preferred stances of the golfer for the various wood and iron shots normally encountered.

Turning now to FIG. 4, the proper stances which should be used by a golfer when addressing a golf ball 25 from a given lie utilizing various different golf clubs have been shown. Thus, in each case the golf swing practice device 10 of the present invention is positioned with its guide edge 26 outboard of the golf ball 25 and lying parallel to the desired line-of-flight of the golf ball as here represented by the arrow 28. The golfer will normally position his/her feet in one (1) of four (4) different stances dependent upon the particular club being employed—viz., (i) an "open" stance as indicated at 37L, 37R when utilizing short irons such as a "7", "8" and/or "9" iron or a wedge; (ii) a "square" stance with the feet relatively close together as indicated at 37L, 37R' when utilizing an intermediate iron such as a "5" or "6" iron; (iii) a slightly wider "square" stance with the right foot moved to the right as indicated at 37R" when utilizing the longer "1", "2", "3" and "4" irons as well as "3", "4" and "5" woods off the fairway; and (iv), a somewhat "closed" stance as indicated at 37L, 37R''' when utilizing a driver. Those skilled in the art will, of course, appreciate that the stances depicted in FIG. 4 and described above are all quite conventional, albeit they are for right-handed golfers.

However, when practicing golf shots utilizing the device 10 of the present invention, the phantom tee 21 is preferably deployed somewhat differently dependent upon the particular club being used. Thus, as shown in FIG. 4, when utilizing the "square" stance depicted at 37L, 37R" for fairway woods—e.g., "3", "4" or "5" woods—and/or longer iron shots—e.g., shots employing a "1", "2", "3" or "4" iron—the phantom tee 21 would preferably be deployed as shown in the drawing, or approximately three inches (3") or four inches (4") in front of the actual lie of the golf ball 25, providing the golfer with a visual indication or target representing the desired location of the bottom of the golfer's downswing. As a consequence, as the golfer brings the club head 38 back along the dotted line trajectory 32, the club head preferably passes closely adjacent and slightly below the level of the swing plane stabilizer 14. During the downswing, the unobtrusive, imaginary barrier defined by the swing plane stabilizer 14 and the guide edge 26 on device 10 induces the golfer to swing the club along the desired inside-out trajectory indicated by the broken line 35, with the club head 38 impacting the golf ball 25 during the downswing approximately three inches (3") or four inches (4") prior to reaching the bottom of the downswing as the club head passes over the phantom tee 21.

Essentially the same description with regard to use of the practice device 10 as set forth above is equally applicable to the use of the device with shorter irons except: (i) when using a "5" or "6" iron, the golfer will, assuming he or she is right-handed, shift his/her right foot to the position indicated at 37R' and move the phantom tee 21 slightly closer to the golf ball—e.g., to approximately two inches (2") forward of the ball—and (ii), when using still shorter irons such as a "7" iron through a wedge, the golfer will move to the "open" stance indicated at 37L, 37R and either not deploy the phantom tee 21 at all or deploy it immediately in front of the lie of the golf ball 25 so as to insure that the club head 38 impacts the ball immediately prior to reaching the bottom of the downswing trajectory 35.

Finally, when utilizing a driver, the golfer will utilize the proper stance as indicated above, but, since it is desired that the club head of a wood impact the golf ball 25 either at the bottom of the downswing or slightly after reaching the bottom of the downswing, the golfer need not deploy the phantom tee 21 for these practice shots, utilizing the ball 25 itself as the target for the bottom of the swing. Alternatively, the phantom tee 21 could, in some instances, be deployed immediately to the rear of the ball 25 so as to induce the golfer to impact the ball after reaching the bottom of the swing.

Figure 5:
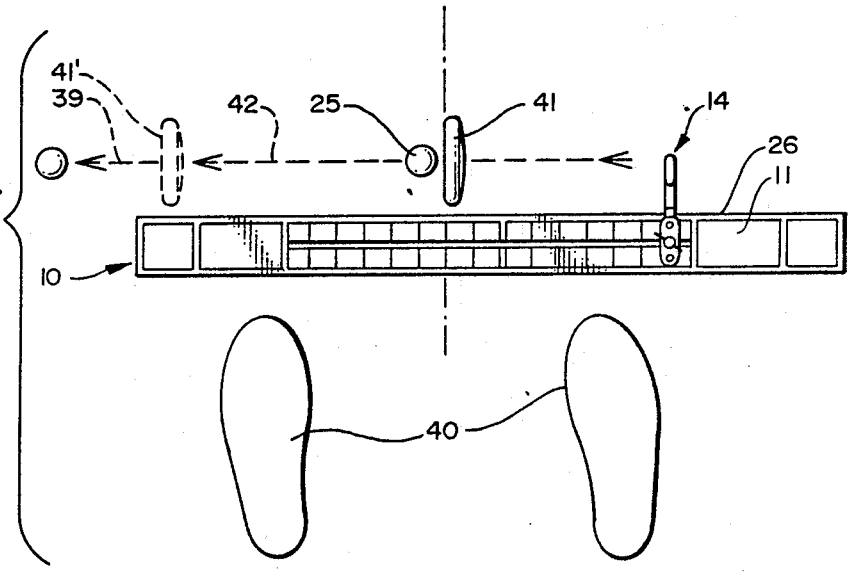
FIG. 5 is a fragmentary diagrammatic plan view of one manner of usage of the device shown in FIG. 1 when practicing putts.
Figure 6:
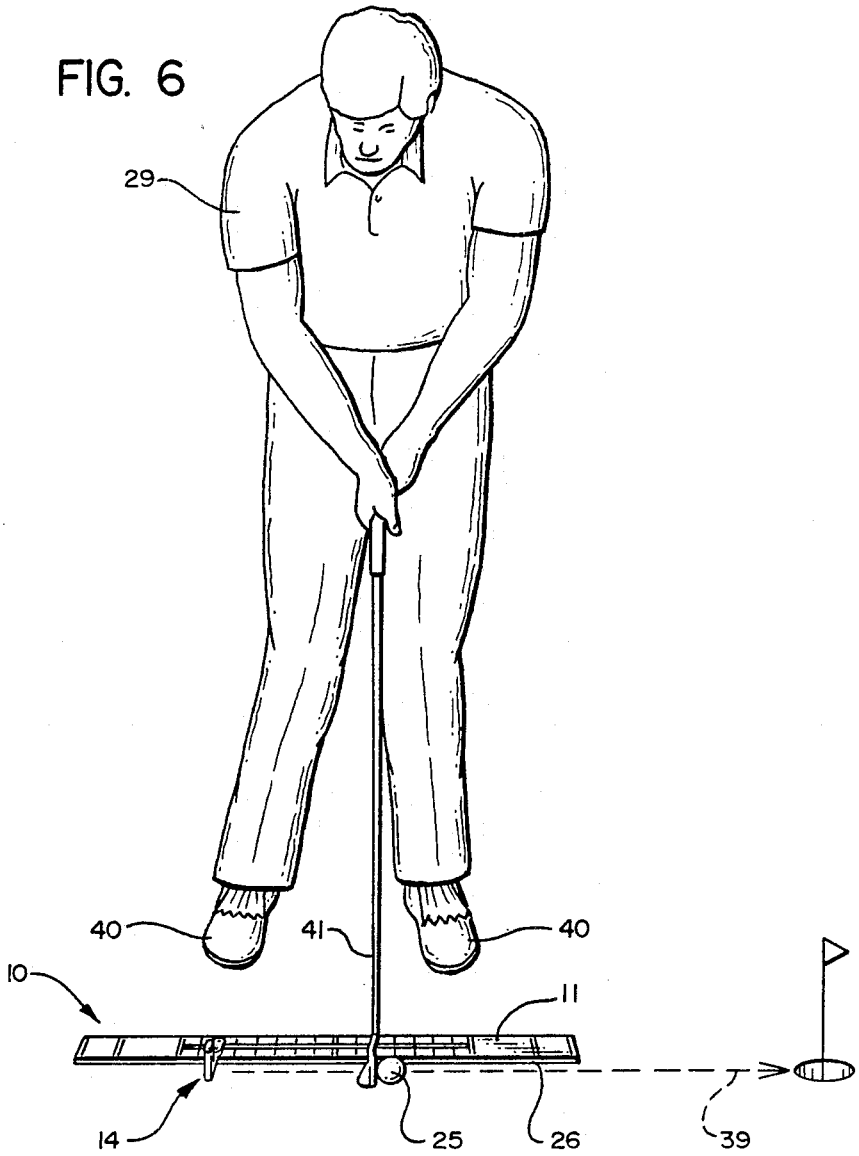
FIG. 6 is a diagrammatic isometric view here illustrating usage of the golf swing practice device of the present invention for putting practice in the manner depicted in FIG. 5; and, FIG. 7 is a fragmentary diagrammatic plan view similar to FIG. 5, but here illustrating a slightly modified way of using the golf swing practice device of the present invention for practice putts.

Turning next to FIGS. 5 and 6, usage of the exemplary golf swing practice device 10 to improve putting will be described. As here shown, the swing plane stabilizer 14 is positioned to the rear of the ball 25 by an incremental distance that can, and will, vary dependent upon the distance the ball is to be stroked and the type of club employed—for example, approximately four inches (4") in the case of a putt of about four feet (4'), approximately five inches (5") in the case of a putt of from about feet (6'), approximately six inches (6") in the case of a putt of about eight feet (8"), etc. Those skilled in the art will, of course, appreciate that the actual distances will vary from golfer to golfer; but, as each golfer becomes more experienced in the use of the device 10, he/she will soon become accustomed to coordinating the distance of the backswing and the speed of the club head when stroking the ball so as to enable stroking the ball any given distance with considerable accuracy. The device 10 is, in this instance, located parallel to the intended path 39 of the ball 25 and between the golfer's feet 40 and the ball 25. ball 25 and between the golfer's feet 40 and the ball 25. The arrangement is such that the swing plane stabilizer 14 tends to limit the golfer's backswing during putting and to promote a straight line accelerating follow-through of the putter 41, as indicated at 42, as it moves from the solid line position 41 at point of impact to the position shown in broken lines at 41'.

Figure 7:
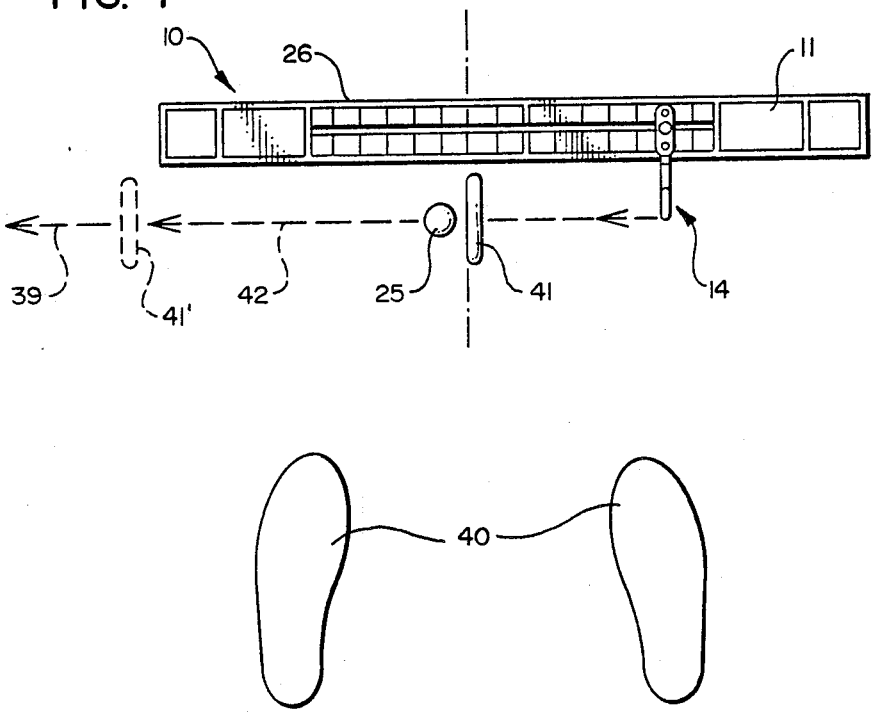

Referring next to FIG. 7, it will be noted that essentially the same practice conditions can be achieved as described in connection with FIGS. 5 and 6 by placing the exemplary golf swing practice device 10 outboard of the golfer's ball 25 rather than between the golfer's feet 40 and the ball.

Thus, those skilled in the art will readily appreciate that there has herein been described a simple, economical and easily portable golf swing practice device which is totally devoid of physical and/or mechanical constraints which tend to unnaturally alter the golfer's stance and/or swing; yet, which effectively constrains the swing to move in a desired inside-out trajectory during the downswing with the club head impacting the golf ball at the proper point in the swing trajectory dependent upon the type of club being employed—i.e., either at or slightly after reaching the bottom of the swing in the case of woods; about four (4") inches or five inches (5") prior to reaching the bottom of the downswing in the case of long and/or intermediate irons; and, immediately prior to reaching the bottom of the downswing in the case of short irons. The device is universally applicable to all types of golfers irrespective of their physical size and/or condition and/or limitations, their sex, age and whether they are left-handed or right-handed. Moreover, the golf swing practice device of the present invention is not limited to use with a particular type or group of clubs, but, rather, can be employed when practicing with any club ranging from a driver or "1" wood through a putter.

We claim:

1. A golf swing practice device comprising, in combination:

(a) means defining an elongate generally flat guide member having a lineal guide edge adapted to be placed on the ground adjacent a golf ball to be struck with said lineal guide edge extending parallel to the desired and intended line-of-flight of the golf ball;

(b) an upstanding l-shaped guide element defining a swing plane stabilizer, said element having a horizontal leg secured to said guide member, and a vertical leg spaced from said guide member in a plane parallel thereto; and (c) means for adjustably, but fixedly, securing said horizontal leg to said elongate generally flat guide member at any selected desired position along the length of said guide member with said vertical leg of said guide member defining an unobtrusive, imaginary, vertical guide plane parallel to the desired and intended line-of-flight of the golf ball so that when a golfer addresses the golf ball to be struck, said unobtrusive, imaginary, vertical guide plane tends to induce the golfer to commence his/her backswing with the club head passing closely adjacent to and somewhat below the upper end of said vertical leg and to cause the golfer's downswing to follow a desired inside-out trajectory.

2. A golf swing practice device as set forth in claim 1 wherein said elongate flat guide member is calibrated by application of incrementally spaced distance marks so as to enable location of said upstanding guide element at a selected known distance rearwardly of the lie of the golf ball.

3. A golf swing practice device as set forth in claim 1 wherein said upstanding guide element is formed of self-supporting, soft, flexible material so as to preclude damage to the golfer's club and/or injury to the golfer in the event the club head inadvertently strikes said upstanding guide element during any portion of the golfer's swing.

4. A golf swing practice device comprising, in combination:

(a) means defining an elongate generally flat guide member having a lineal guide edge adapted to be placed on the ground adjacent a golf ball to be struck with said lineal guide edge extending parallel to the desired and intended line-of-flight of the golf ball, said guide member including an elongate vertical slot extending along a substantial portion of the length of said guide member;

(b) an upstanding L-shaped guide element defining a swing plane stabilizer and having a vertically upstanding leg spaced from said guide member in a plane parallel thereto and an integral horizontal leg with said horizontal leg lying on said guide member and extending transversely over said slot; and (c) fastener means passing through said slot and said horizontal leg for separably, but fixedly, securing said guide element to said elongate generally flat guide member in any desire adjustable position along the length of said slot with said vertically upstanding leg defining an unobtrusive, imaginary, vertical guide plane parallel to the desired and intended line-of-flight of the golf ball so that when a golfer addresses the golf ball to be struck, said unobtrusive imaginary vertical plane tends to induce the golfer to commence his/her backswing with the club head passing closely adjacent to and somewhat beneath the upper end of said vertically upstanding leg and to cause the golfer's downswing to follow a desired inside-out trajectory.

5. A golf swing practice device as set forth in claim 4 wherein said elongate generally flat guide member is calibrated by application of incrementally spaced distance marks so as to enable location of said upstanding guide element at a selected known distance rearwardly of the lie of the golf ball.

6. A golf swing practice device as set forth in claim 4 wherein said upstanding guide element is formed of self-supporting, soft, flexible material so as to preclude damage to the golfer's club and/or injury to the golfer in the event the club head inadvertently strikes said upstanding guide during any portion of the golfer's swing.

7. A golf swing practice device for use with long, intermediate and short irons comprising, in combination:

(a) means defining an elongate generally flat guide member having a lineal guide edge adapted to be placed on the ground adjacent a golf ball to be struck with said lineal guide edge extending parallel to the desired and intended line-of-flight of the golf ball;

(b) an upstanding l-shaped guide element defining a swing plane stabilizer, said element having a horizontal leg secured to said guide member, and a vertical leg spaced from said guide member in a plane parallel thereto;

(c) means for adjustably, but fixedly, securing said horizontal leg to said elongate generally flat guide member at any selected desired position along the length of said guide member with said vertical leg of said guide member defining an unobtrusive, imaginary, vertical guide plane parallel to the desired and intended line-of-flight of the golf ball; and (d) target defining means separably coupled to said guide member and adapted to be deployed laterally therefrom for defining the desired location of the low point of the golfer's swing, said target defining means being disposed forward of the lie of the golf ball so that when a golfer addresses the golf ball to be struck, said target defining means is located at the bottom of the golfer's swing and so that said unobtrusive, imaginary, vertical guide plane tends to induce the golfer to commence his/her backswing with the club head passing closely adjacent to and somewhat beneath the upper end of said vertical leg and to cause the golfer's downswing to follow a desired inside-out trajectory with the club head impacting the golf ball during that portion of the golfer's down swing prior to the club head reaching said target defining means.

8. A golf swing practice device as set forth in claim 7 wherein said elongate generally flat guide member is calibrated by application of incrementally spaced distance marks so as to enable location of said upstanding guide element at a selected known distance rearwardly of the lie of the golf ball and so as to enable location of said target defining means at a selected known distance forward of the lie of the golf ball.

9. A golf swing practice device as set forth in claim 7 wherein said upstanding guide element is formed of self-supporting, soft, flexible material so as to preclude damage to the golfer's club and/or injury to the golfer in the event the club head inadvertently strikes said upstanding guide element during any portion of the golfer's swing.

* * * * *